US005664537A

United States Patent [19]

Beranek et al.

[11] Patent Number: 5,664,537

[45] Date of Patent: Sep. 9, 1997

[54] FLEXIBLE OIL PAN ASSEMBLY

[75] Inventors: Terry L. Beranek, Lafayette; Joseph R. Brinker, W. Lafayette; Stephen Lawrence, Lafayette, all of Ind.

[73] Assignee: Caterpillar Inc., Peoria, Ill.

[21] Appl. No.: 709,935

[22] Filed: Sep. 9, 1996

[51] Int. Cl.[6] ..... F02F 7/00

[52] U.S. Cl. ..... 123/195 C; 123/195 H; 184/106

[58] Field of Search ..... 123/196 R, 195 C, 123/195 H; 184/106

[56] References Cited

U.S. PATENT DOCUMENTS 4,876,998 10/1989 Wünsche ..... 123/195 H 4,911,118 3/1990 Kageyania et al. ..... 123/195 C 5,388,556 2/1995 Angus et al. ..... 123/195 C 5,469,822 11/1995 Mechsner ..... 123/195 C

*Primary Examiner*—Erick R. Solis

*Attorney, Agent, or Firm*—Alan J. Hickman

[57] ABSTRACT

A flexible oil pan assembly of a flexible internal combustion engine has a plurality of spaced apart flexible baffles disposed between and connected to a first surface of first and second spaced apart side walls and a plurality of stiffening ribs connected to a second surface of the first and second side walls at preselected spaced locations. The combination of the baffles and stiffening ribs facilitates controlled deflection of the first and second side walls and reduces the potential for cracking of the first and second side walls.

12 Claims, 2 Drawing Sheets

FLEXIBLE OIL PAN ASSEMBLY

TECHNICAL FIELD

The present invention relates to a flexible oil pan assembly having a plurality of spaced external ribs and a plurality of spaced internal flexible baffles disposed between the external ribs.

BACKGROUND ART

Flexible oil pans have been provided for use with internal combustion engines having flexible engine blocks. Flexible engine blocks are associated with high horsepower engines (6000 HP), for example, of the type used in electric generation, fluid pumping, ocean going vessels and the like. Flexible engine blocks have been provided to improve access for engine remanufacturing. Flexible oil pans have been provided to accommodate flexing of the engine during operation and to maintain a tight seal between the engine block and the oil pan at the connection of the oil pan to the engine block.

One example of a flexible engine having a flexible oil pan is disclosed in U.S. Pat. No. 5,388,556 to William G. Angus etal. By providing an oil pan with flexible baffles the oil pan is able to flex with the engine. The baffles being flexible reduces the potential for cracking and breakage associated with stiff baffles. However, cracks in the side walls at locations in close proximity to the baffles often develop. It was found that stress risers at locations adjacent the connection of the baffles caused the related cracking in the side walls.

The solution to the problem of providing an oil pan with the necessary flexibility to accommodate a flexible engine block and the strength to resist buckling, cracking and the like have not been previously found.

The present invention is directed to overcoming one or more of the problems as set forth above.

DISCLOSURE OF THE INVENTION

A flexible oil pan assembly for attachment to a flexible engine block has first and second spaced apart elongated flexible side walls each having first and second ends and first and second side surfaces. First and second spaced apart end walls are connected to the first and second ends, respectively, of the first and second side walls. A bottom wall is connected to the first and second side and end walls at a location adjacent to a lower end of the first and second side and end walls. A flange is connected to the first and second side and end walls at a location adjacent to an upper end of the first and second side and end walls. A plurality of flexible baffles are disposed between and connected to the first side surface of the first and second side walls at predetermined spaced apart locations along the side walls and extend between the bottom wall and the flange. The baffles enable relative deflection of the first and second side walls at the spaced apart locations. A plurality of stiffening ribs are connected to the second surface of the first and second side walls and extend in directions between the bottom wall and flange and away from said second surface. The stiffening ribs being located along the side walls at predetermined spaced locations restrains the side walls from cracking at locations adjacent the baffles and allows a controlled amount of flexing of the oil pan to accommodate flexible engine block movement.

BEST MODE FOR CARRYING OUT THE INVENTION

Figure 1:
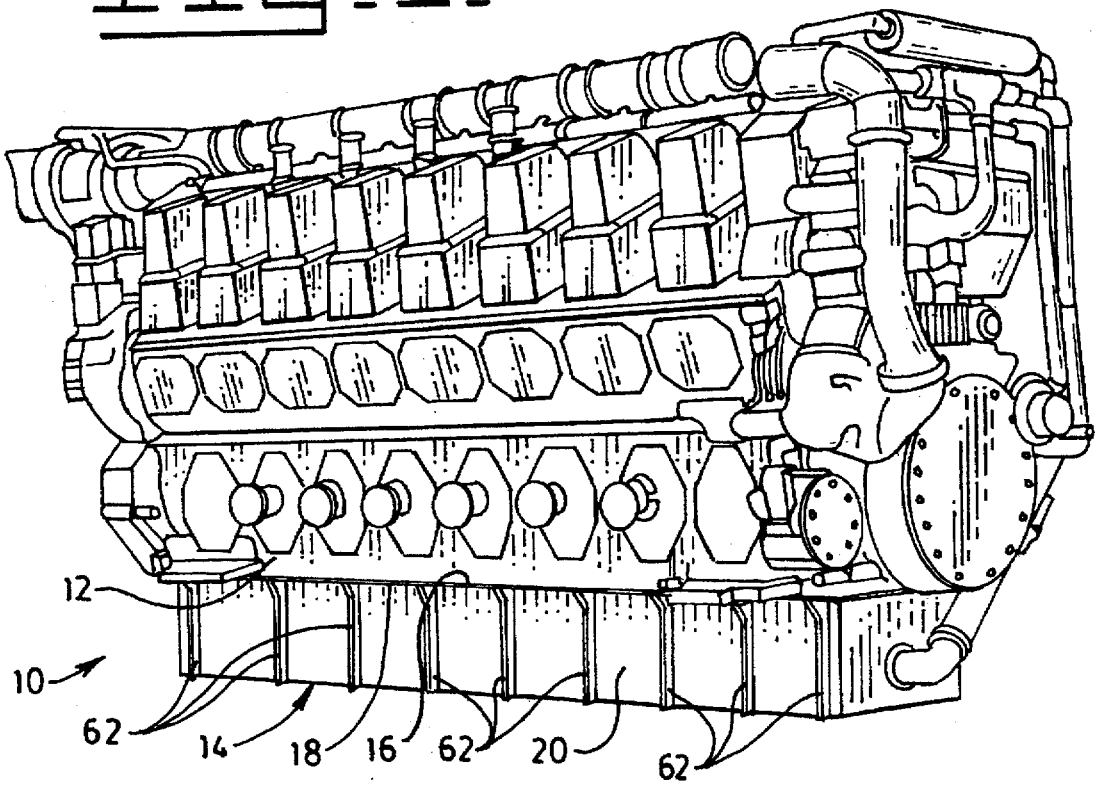
FIG. 1 is a diagrammatic isometric drawing of an embodiment of the present invention showing a flexible oil pan assembly mounted on a flexible engine block.

Referring to the drawings and particularly FIG. 1, an internal combustion engine 10 having a flexible engine block 12 and a flexible oil pan assembly 14 is shown. Such engines are resiliently mounted to a base, for example, by springs (not shown). The internal combustion engine shown is a primarily used in power generation, fluid pumping and marine applications. However, other applications in which a flexible engine block is utilized is considered with in the scope of the invention. Such flexible internal combustion engines normally are diesel type engines, develop thousands of horsepower and exceed 2500 mm in length.

The flexible oil pan assembly 14 has a flange 16 which is connected to a flange 18 of the flexible engine block 12 by a plurality of threaded fasteners (not shown), for example bolts, in a conventional manner. The flange 16 extends outwardly from the oil pan assembly 14 in order to provide access to the threaded fasteners.

Figure 4:
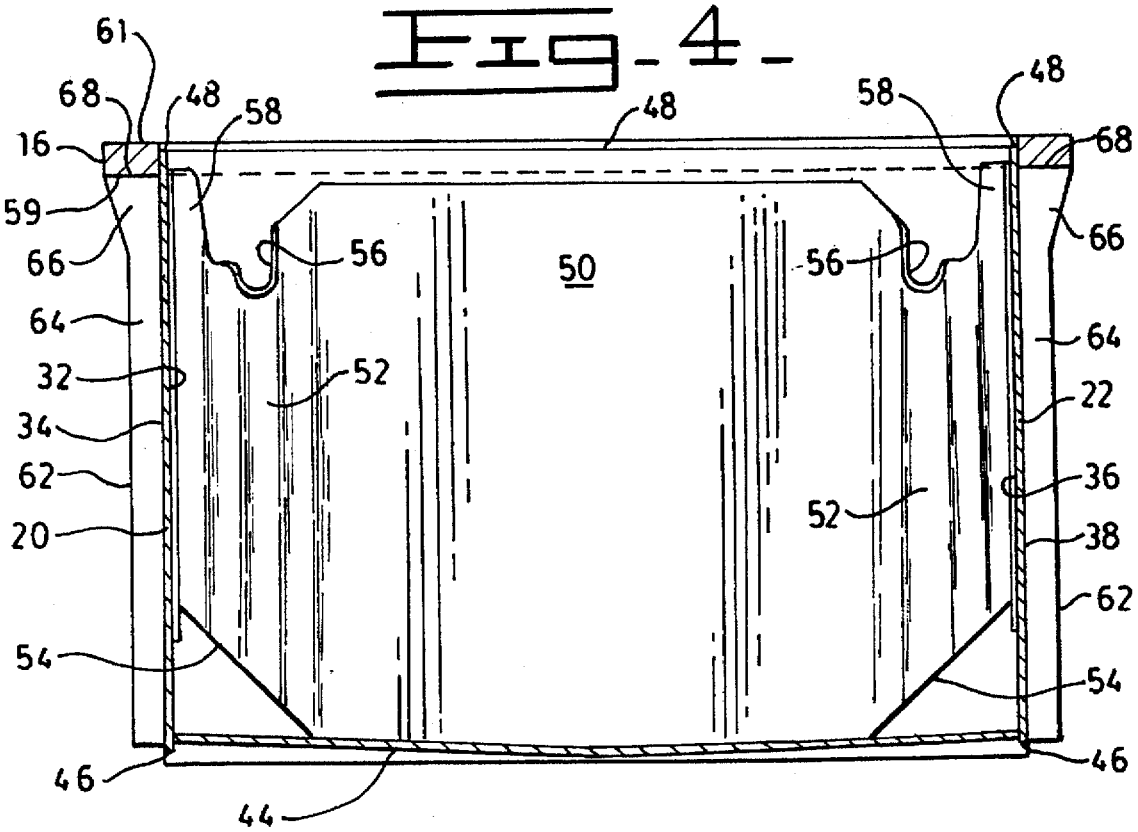
FIG. 4 is a cross section of the flexible oil pan assembly taken along lines 4—4 of FIG. 3.
Figure 2:
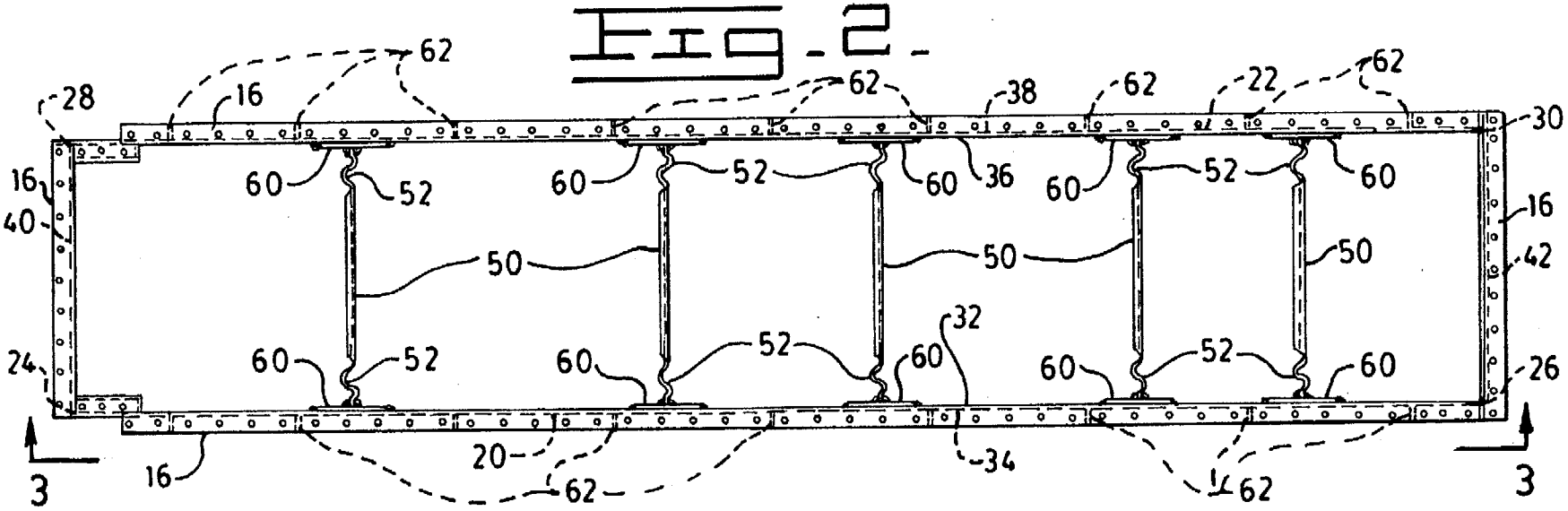
FIG. 2 is a diagrammatic top view of the flexible oil pan assembly.
Figure 3:
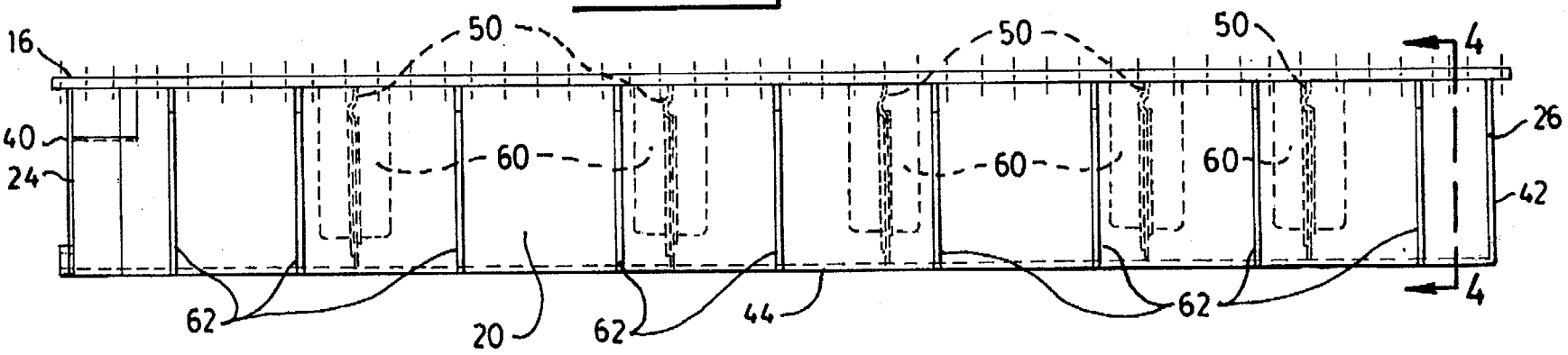
FIG. 3 is a diagrammatic side view of the flexible oil pan assembly taken along lines 3—3 of FIG. 2.

The oil pan assembly 14 of this invention, in order to accommodate flexing of the engine block, is fabricated in a manner to permit flexing thereof without any detrimental effects such as cracking, leaking at the flange 16,18 connections and the like. Referring to FIGS. 2–4, the oil pan assembly has a first and second spaced apart elongated flexible side walls 20,22. The first side wall 20 has first and second ends 24,26 and the second side wall 22 has first and second ends 28,30. The first and second side walls 20 have first and second side surfaces 32,34,36,38.

First and second spaced apart end walls 40,42 are connected to the first and second ends 24,28,26,30, respectively, of the first and second side walls 20,22. A bottom wall 44 is connected to the first and second side and end walls 20,22, 40,42 at a location adjacent to a lower end 46 of the first and second side and end walls 20,22,40,42. The flange 18 is connected to the first and second side and end walls 20,22, 40,42 at a location adjacent to an upper end 48 of each of the first and second side and end walls 20,22,40,42 spaced from the lower end 46. The side and end walls 20,22,40,42 are made from a sheet metal of a predetermined thickness and connected together by welding.

A plurality of flexible baffles 50 are disposed between and connected to the first side surfaces 32,36 of the first and second side walls 20,22 at predetermined longitudinally spaced apart locations along the side walls 20,22. The flexible baffles 50 extend elevationally between the bottom wall 40 and the flange 16. The baffles are substantially planar, substantially parallel to each other, perpendicular to said first and second side walls 20,22 and oriented normal to the flange 16.

The baffles 50 enable relative deflection of the first and second side walls at said spaced apart locations to accommodate deflection of the flexible engine block 12. In order to achieve this flexibility the baffles 50 each have a pair of spaced apart curvilinear portions 52 extending elevationally in directions between the bottom 44 and the flange 16. The curvilinear portions 52 are preferably sinuous in transverse cross section and oriented substantially parallel to each other in the direction of elevational extension. It is to be noted that other shapes providing similar flexibility are equivalents and within the scope of this invention. The baffles are flexible at said curvilinear portions and movable to permit relative movement of the first and second side walls 20,22.

The baffles 50 each have truncated corners 54 at locations adjacent the bottom 44 and a pair of spaced apart cutouts 56 to support a service tool (not shown) during main bearing (not shown) servicing. The truncated corners and other openings (not shown) in the baffles allow fluid to pass therethrough. The baffles 50 each have a pair of spaced first end portions 58 defined by the cutouts 56. The first end portions 58 are located between the first side surfaces 32,36 and between first and second ends 59,61 of the flange. Being located between the first and second ends 59,61 of the flange increases the strength of the connection between the baffles and the side walls 20,22 and reduces the potential for cracking of the side walls 20,22 at locations adjacent the baffles 50.

The baffles 50 each have a rectangular plate 60 at the location of connection between the baffles 50 and the first side surfaces 32,36 of the first and second side walls 20,22. The baffles 50 are welded to the plates 60 and the plates 60 are welded to the first side surface of the first and second side walls 20,22. The welds connecting the baffles 50 the side walls 20,22 are preferably about a periphery of the plates 60 and along the elevational length of the baffle 50 between the flange 16 and the bottom 44. The plates 60 serve to evenly distribute loading, and reduce stress risers at the side wall connection.

A plurality of stiffening ribs 62 are connected to the second surfaces 34,38 of the first and second side walls 20,22 and extend in elevational directions between the bottom wall 44 and the flange 16 and outwardly from said second surfaces 34,38. The stiffening ribs 62 are located along the side walls at predetermined spaced locations between the flexible baffles 50. The stiffening ribs 62 are substantially parallel to each other and to the baffles 50. The stiffening ribs 62 have a rectangular portion 64 and an enlarged end portion 66 terminating at an end 68 adjacent the flange 16. The enlarged end portion gradually increases in magnitude as it approaches the flange 16.

The stiffening ribs 62 are manufactured from steel plate and welded to the second side surfaces 34,38 and the flange 16. The welds are preferably intermittently spaced apart along the elongated stiffening ribs 62 on opposite sides thereof. The enlarged end portion 66 is welded to the flange at the first side 59 the end 68 thereof.

In order to provide enough flexibility in the oil pan 14 to accommodate engine block 12 movement the number of stiffening ribs 62 and the relative locations thereof are carefully determined. It has been found that the ribs 62 need to be located longitudinally in line with the bulkheads (not shown) of the engine block 12. As known by those skilled in the art, a plurality of bulkheads extend transversely between the sides of the engine block 12 and provide support for engine crankshaft bearings. The stiffening ribs 62 are also spaced from overlying the flanges 60 so that support is provided at appropriate locations on the side walls. The longitudinal location of the stiffening ribs 62, which happens to be between the spaced apart baffles 50, eliminates excessive flexing and distortion of the side walls 20,22 and serves to eliminate the potential for cracking of the side walls 20,22.

INDUSTRIAL APPLICABILITY

With reference to the drawings, and in operation, the flexible engine block 12 of the resiliently mounted internal combustion engine 10 deflects based on first and second order harmonics during engine operation. This deflection is transferred to the flexible oil pan assembly 14 through the connection of the flexible oil pan assembly 14 to the flexible engine block 12 at the flanges 16,18. The flexible oil pan assembly responds to this motion and flexes at the first and second side walls 20,22 in order to maintain an oil tight seal at the flanges 16,18 and prevent damage to the flexible oil pan assembly 14.

The baffles 50 enable the first and second side walls 20,22 to relatively deflect and move in response to movement of the engine block 12. Cracking of the first and second side walls 20,22 at the connections between the baffles 50 and the side walls 20,22 caused by side wall movement is resisted by way of the plates 60 and the plurality of stiffening ribs 62 connected to the second side surfaces 34,38 of the first and second side walls 20,22.

The stiffening ribs 62 reduces the potential for localized movement of the side walls 20,22 longitudinally between the baffles 50 as caused by engine block deflection and thereby reduces the potential for cracks to develop at the gusset connections. Having the stiffening ribs 62 connected to the flange 16 also facilitates a controlled transfer of forces and reduces the potential for undesirable localized movement.

With the stiffening ribs 62 located at the optimum position relative to the baffles 50 flexing of the side walls 20,22 in response to movement of the flexible engine block 12 is achieved without damage to the flexible oil pan assembly 14.

Other aspects, objects and advantages of the present invention can be obtained from a study of the drawings, the disclosure and the appended claims.

We claim:

1. A flexible oil pan assembly for attachment to a flexible engine block, comprising:

a first and a second spaced apart elongated flexible side walls each having first and second ends and first and second side surfaces;

a first and a second spaced apart end walls connected to the first and second ends, respectively, of the first and second side walls;

a bottom wall connected to the first and second side and end walls at a location adjacent to a lower end of the first and second side and end walls;

a flange connected to the first and second side and end walls at a location adjacent to an upper end of the first and second side and end walls;

a plurality of flexible baffles disposed between and connected to the first side surface of the first and second side walls at predetermined spaced apart locations along the side walls and extending between the bottom wall and the flange, said baffles enabling relative deflection of the first and second side walls at said spaced apart locations;

a plurality of stiffening ribs connected to the second surface of the first and second side walls and extending in directions between the bottom wall and flange and away from said second surface, said stiffening ribs being located along the side walls at predetermined spaced locations.

2. A flexible oil pan assembly, as set forth in claim 1, wherein said plurality of stiffening ribs are elongated and welded to said second side surface and said flange.

3. A flexible oil pan assembly, as set forth in claim 2, wherein said welds are intermittent along the elongated stiffening ribs.

4. A flexible oil pan assembly, as set forth in claim 2, wherein said stiffening ribs have a rectangular portion and an enlarged end portion at an end adjacent the flange.

5. A flexible oil pan assembly, as set forth in claim 4, wherein said enlarged end portion is welded to said flange.

6. A flexible oil pan assembly, as set forth in claim 4, wherein said stiffening ribs are substantially parallel to each other.

7. A flexible oil pan assembly, as set forth in claim 6, wherein said baffles are substantially parallel to each other, parallel to said stiffening ribs and perpendicular to said first and second side walls.

8. A flexible oil pan assembly, as set forth in claim 2, wherein said flexible baffles each have a pair of spaced apart curvilinear portions extending in directions between said bottom surface and said flange, said baffles being flexible at said curvilinear portions and movable to permit relative movement of the first and second side walls.

9. A flexible oil pan assembly, as set forth in claim 8, wherein said baffles each have a rectangular plate at the location of connection between the baffles and the first side surface of the first and second side walls.

10. A flexible oil pan assembly, as set forth in claim 9, wherein said baffles are welded to the plates and the plates are welded to the first side surface of the first and second side walls.

11. A flexible oil pan assembly, as set forth in claim 10, wherein the flange is oriented normal to the baffles.

12. A flexible oil pan assembly, as set forth in claim 11, wherein the flange has first and second surfaces and said baffles each have a pair of spaced first end portions located between the first side surface of the first and second side walls and between the first and second ends of the flange.

* * * * *